United States Patent [19]

Brotherston

[11] Patent Number: 4,546,745

[45] Date of Patent: Oct. 15, 1985

[54] FUEL PUMPING APPARATUS

[75] Inventor: Colin P. Brotherston, Rainham, England

[73] Assignee: Lucas Industries public limited company, Birmingham, England

[21] Appl. No.: 560,512

[22] Filed: Dec. 12, 1983

[51] Int. Cl.[4] ..... F02M 39/00

[52] U.S. Cl. ..... 123/387; 123/198 D; 123/479; 417/199 R

[58] Field of Search ..... 123/387, 198 D, 385, 123/479, 502, 357–359; 417/199, 286

[56] References Cited

U.S. PATENT DOCUMENTS 3,745,982 7/1973 Suda ..... 123/357
4,407,250 10/1983 Eheim ..... 123/502

FOREIGN PATENT DOCUMENTS 49550 5/1939 France ..... 123/387
229690 11/1943 Switzerland ..... 123/387

*Primary Examiner*—Carl Stuart Miller

[57] ABSTRACT

A fuel pumping apparatus includes a high pressure pump and a low pressure pump which supplies fuel thereto. A further low pressure pump supplies fuel at a pressure which is modified to provide a control pressure which is used to control the delivery quantity of the pump. The pump draws fuel from the lower portion of a reservoir and the pump from the upper portion whereby in the event of fuel starvation the high pressure pump will be starved of fuel before the control pressure is lost.

11 Claims, 1 Drawing Figure

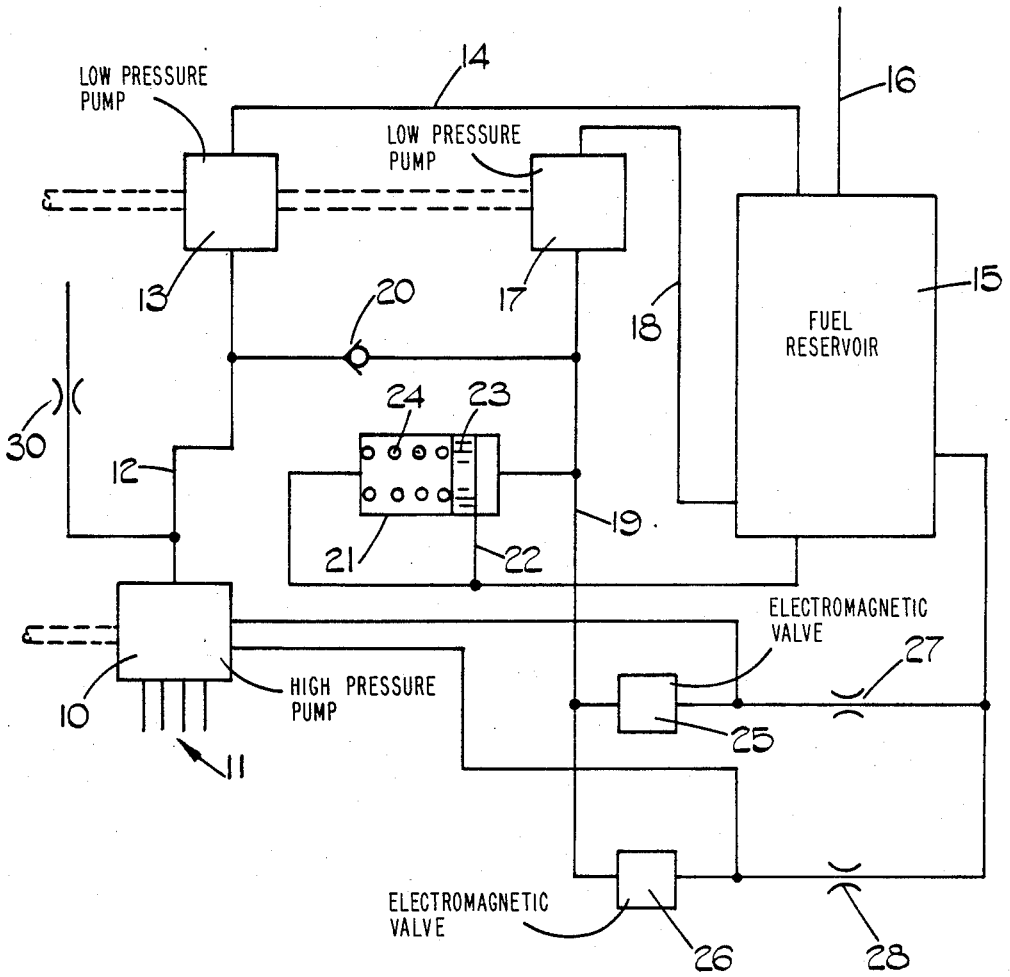
LOW PRESSURE PUMP
14
16
LOW PRESSURE PUMP
13
17
20
18
15
FUEL RESERVOIR
30
24
23
12
19
21
22
ELECTROMAGNETIC VALVE
27
10
HIGH PRESSURE PUMP
25
11
ELECTROMAGNETIC VALVE
26
28

FUEL PUMPING APPARATUS

This invention relates to a fuel pumping apparatus for supplying fuel to an internal combustion engine and of the kind comprising a high pressure pump operable in use in timed relationship with the engine, a low pressure pump for supplying fuel to the high pressure pump and means operable to control the amount of fuel supplied to the engine, said means including a surface against which liquid under pressure can act to vary the setting of said means.

One form of such an apparatus is disclosed in British published Application No. 2037365A, in which said surface is defined by an end surface of the distributor member of the high pressure pump, the distributor member being moved as the fluid pressure increases, against the action of a spring to reduce the amount of fuel supplied by the apparatus.

Another form of apparatus includes a throttle which controls the flow of fuel from the low pressure pump to the high pressure pump. The throttle member has a surface against which fluid under pressure can act and with increasing pressure the throttle member is moved against the action of a spring to reduce the fuel flow to the high pressure pump.

In both forms of apparatus the fluid under pressure is derived from the aforesaid low pressure pump and in normal operation, the apparatus functions in an adequate manner. A problem can however arise if air starts to enter the low pressure pump due, for example, to the fact that the fuel tank from which fuel is drawn may have become empty. In such a situation the output pressure of the low pressure pump starts to fall. In the case of the apparatus incorporating a throttle, the throttle member will respond to the reduced fuel pressure by moving to allow an increased flow of fuel to the high pressure pump. Even though the flow of fuel through the low pressure pump may be reduced, there may be an increase in the flow of fuel to the high pressure pump. This would lead to an increase in the engine speed and the governing action of the apparatus will therefore be impaired. In the case of the apparatus described in the aforementioned published specification, the fuel pressure applied to the distributor member will usually be lower than the output pressure of the low pressure pump and hence the reduced output pressure may not have an immediate effect, since the control system associated with the pump will take care of the reduction in pressure. However, if the output pressure continues to fall there will eventually be a reduction in the pressure applied to the distributor member possibly leading to an increase in the quantity of fuel supplied by the apparatus. Again the governing action of the apparatus is impaired.

The object of the present invention is to provide an apparatus of the kind specified in an improved form.

According to the invention, an apparatus of the kind specified includes a fuel reservoir, a further low pressure pump which draws fuel from the lower portion of said reservoir, the output of said further low pressure pump being utilized to provide the pressure on said surface.

An example of an apparatus in accordance with the invention will now be described with reference to the accompanying diagram.

Referring to the diagram, there is indicated at 10, a high pressure pump having a plurality of outlets 11 for connection in use, to injection nozzles of an associated engine. The pump 10 is driven in timed relationship with the engine and is of the type described in the aforementioned published British specification. The high pressure pump has a fuel inlet which is connected by a conduit 12 to a low pressure pump 13 which has an inlet conduit 14 extending to the upper portion of a fuel reservoir 15. The reservoir 15 has an inlet 16 which is connected to a fuel supply tank.

The apparatus includes a further low pressure pump 17 which has an inlet conduit 18 connected to the lower portion of the reservoir 15. The pump 17 has an outlet conduit 19 and the conduits 12 and 19 are interconnected by a one way valve 20 which can open to allow fuel flow from the conduit 12 to the conduit 19 but which can close to prevent flow of fuel in the opposite direction.

The output pressures of the two pumps are controlled by a pressure relief valve 21 which includes a cylinder having one end connected to the conduit 19 and its opposite end together with a spill port 22 in the wall of the cylinder, connected to a drain conveniently the reservoir 15. Located in the cylinder is a piston 23 which is biased towards the one end of the cylinder by a spring 24. The arrangement is such that as the pressure in the conduit 19 increases, the piston 23 will move against the action of the spring 24 to progressively open the port 22 to allow fuel to flow from the conduit to the reservoir, thereby controlling the pressure of fuel in the conduit 19 and also, due to the action of the valve 20, in the conduit 12.

The fuel under pressure which is supplied by the pump 17 is utilized as a source of pressure from which two control pressures are applied to the high pressure pump.

As shown, the conduit 19 communicates with a pair of electro-magnetically operated valves 25, 26 the flow of electric current in which is determined by the pump control system. The valves by way of restrictors 27, 28 respectively, communicate with the reservoir 15 and points intermediate the valves and restrictors are connected by conduits respectively to the injection pump. The valve 25 together with the restrictor 27 is utilised to provide the fuel under pressure which is applied to the end surface of the distributor member of the high pressure pump. In this example the axial position of the distributor member is adjustable to determine the amount of fuel supplied by the apparatus. The valve 26 together with the restrictor 28 is utilized to derive a pressure which is applied to a timing adjusting piston whereby the timing of delivery of fuel by the apparatus can be varied.

In use, the pumps 13 and 17 draw fuel from the reservoir 15 and in so doing a fresh supply of fuel is drawn into the reservoir from the fuel tank. When the reservoir is completely full of fuel, the pump 13 supplies an excess of fuel to that which is pumped by the high pressure pump 10 and the valve 20 therefore opens to permit flow of fuel into the conduit 19. The output pressures of both pumps are controlled by the valve 21.

If air is drawn into the reservoir from the tank 16, since the inlet conduit 14 opens into the upper portion of the reservoir 15, the low pressure pump 13 will tend to draw air and its output pressure will fall thereby allowing the valve 20 to close. As air is drawn into the high pressure pump, less fuel will flow to the engine and as the volume of air increases, the flow of fuel to the engine will decrease to the extent that the engine may stall. The pump 17, however, since it draws fuel from the lower portion of the reservoir, will continue to supply fuel to the conduit 19 and its pressure will continue to be regulated by the valve 21. The control pressures therefore applied to the high pressure pump will be maintained and the governing action will also be maintained. The pressure at the inlet of the high pressure pump 10 can be made to drop more quickly by providing a restricted orifice 30 in a branch conduit leading back to the fuel supply tank.

Since the pump 17 draws fuel from the lower portion of the reservoir 15, it may be necessary to incorporate a filter in the inlet conduit 18. The reservoir 15 will normally be defined within the housing of the apparatus and may form part of the space containing the distributor member. The fuel which flows through the restrictors 27 and 28 may be returned to the fuel tank rather than to the reservoir although, this has the disadvantage that the pump 17 may become starved of fuel.

In a modification of the apparatus shown in the diagram, the pump 13 draws fuel direct from the fuel tank and the inlet 16 is omitted. In this case the reservoir 15 again constituted by the space within the housing of the pump is connected by way of a restricted orifice back to the fuel tank and there can be connected in parallel with this orifice, a regulating valve which acts to limit the pressure rise in the reservoir. In this modification the reservoir is maintained full of fuel when the apparatus is in use by the flow of fuel which takes place through the valve 20 from the pump 13.

I claim:

1. A fuel pumping apparatus for supplying fuel to an internal combustion engine comprising a high pressure pump operable in use, in timed relationship with the engine, a low pressure pump having an outlet for supplying fuel to the high pressure pump, means operable to control the amount of fuel supplied to the engine, said means including a surface against which liquid under pressure can act to vary the setting of said means, a fuel reservoir, and a further low pressure pump having an outlet which draws fuel from the lower portion of said reservoir, the output of said further low pressure pump being utilized to provide the pressure on said surface, and the outlets of said low pressure pumps being interconnected through a one way valve which allows flow of fuel from the outlet of the first mentioned low pressure pump to the outlet of the further pump.

2. An apparatus according to claim 1 including a pressure relief valve connected to the outlet of the further pump, said pressure relief valve acting to control the output pressure of the low pressure pumps.

3. An apparatus according to claim 2 in which the fuel spilled from the outlets of said low pressure pump by said relief valve is returned to said reservoir.

4. An apparatus according to claim 3 in which the inlet of said first mentioned low pressure pump is connected to a source of fuel.

5. An apparatus according to claim 4 including valve means for limiting the pressure in said reservoir.

6. An apparatus according to claim 3 in which the inlet of said first mentioned low pressure pump is connected to said reservoir so as to draw fuel from the upper portion of the reservoir, said reservoir having a fuel inlet which is connected to a source of fuel.

7. An apparatus according to any one of the preceding claims including valve means for controlling the pressure applied to said surface, said valve means including an eletrically operated valve connected in a series circuit between the outlet of said further pump and a low pressure source, said series circuit including a restrictor, the pressure intermediate said valve and said restrictor being applied to said surface.

8. An apparatus according to claim 7 in which said low pressure source is constituted by the reservoir.

9. An apparatus as claimed in claim 7 in which said low pressure source comprises the source of fuel.

10. An apparatus according to claim 1 including a restricted orifice through which fuel can flow from the output of said first mentioned low pressure pump to a drain.

11. A fuel pumping apparatus for supplying fuel to an internal combustion engine comprising a high pressure pump operable in use, in timed relationship with the engine, a fuel reservoir, a low pressure pump for supplying fuel to the high pressure pump, said low pressure pump drawing fuel from an upper portion of the reservoir, means operable to control the amount of fuel supplied to the engine, said means including a surface against which liquid under pressure can act to vary the setting of said means, and a further low pressure pump which draws fuel from a lower portion of said reservoir, the output of said further low pressure pump being utilized to provide the pressure on said surface.

* * * * *